United States Patent [19]

Katori et al.

[11] Patent Number: 5,014,397

[45] Date of Patent: May 14, 1991

[54] DETACHING ROLLER DRIVING MECHANISM FOR A COMBER EMPLOYING TWO DRIVING SYSTEMS

[75] Inventors: Mutsuhiko Katori, Nagoya; Kazuo Yamada, Anpachi, both of Japan

[73] Assignee: Kabushikikaisha Hara Shokki Seisakusho, Gifu, Japan

[21] Appl. No.: 526,898

[22] Filed: May 22, 1990

[30] Foreign Application Priority Data

Sep. 8, 1989 [JP] Japan ..... 1-231712

[51] Int. Cl.[5] ..... D01G 19/20

[52] U.S. Cl. ..... 19/231

[58] Field of Search ..... 19/231, 232

[56] References Cited

U.S. PATENT DOCUMENTS 3,290,731 12/1966 Katori ..... 19/231
3,960,024 6/1976 Mori et al. ..... 19/231 X

FOREIGN PATENT DOCUMENTS 36-14570 8/1961 Japan .
43-10728 5/1968 Japan .
43-10731 5/1968 Japan .
44-17573 8/1969 Japan .
53-15178 5/1978 Japan .
3028918 2/1988 Japan ..... 19/231

*Primary Examiner*—Werner H. Schroeder
*Assistant Examiner*—John J. Calvert
*Attorney, Agent, or Firm*—Burns, Doane, Swecker & Mathis

[57] ABSTRACT

A differential gear mechanism for driving a detaching roller of a comber includes two driving systems. One of the driving systems converts constant-speed rotational motion into variable-speed rotational motion through a crank mechanism and a quadric crank mechanism. The variable-speed rotational motion is transmitted to the input shaft of the differential mechanism. The other driving system converts constant-speed rotational motion into swing motion by a crank mechanism, converts the swing motion into reciprocating motion by way of connecting rods and linkage, and transmits the reciprocating motion to a planet pinion of the differential gear mechanism. The feed motion curve of the detaching roller produced by the differential gear mechanism is an ideal curve similar to that obtained by an ideally designed cam comber.

1 Claim, 7 Drawing Sheets

D1
D2
A1
A2
C
C1
C2
R
L
G

SURFACE FEED DISTANCE OF DETACHING ROLLER

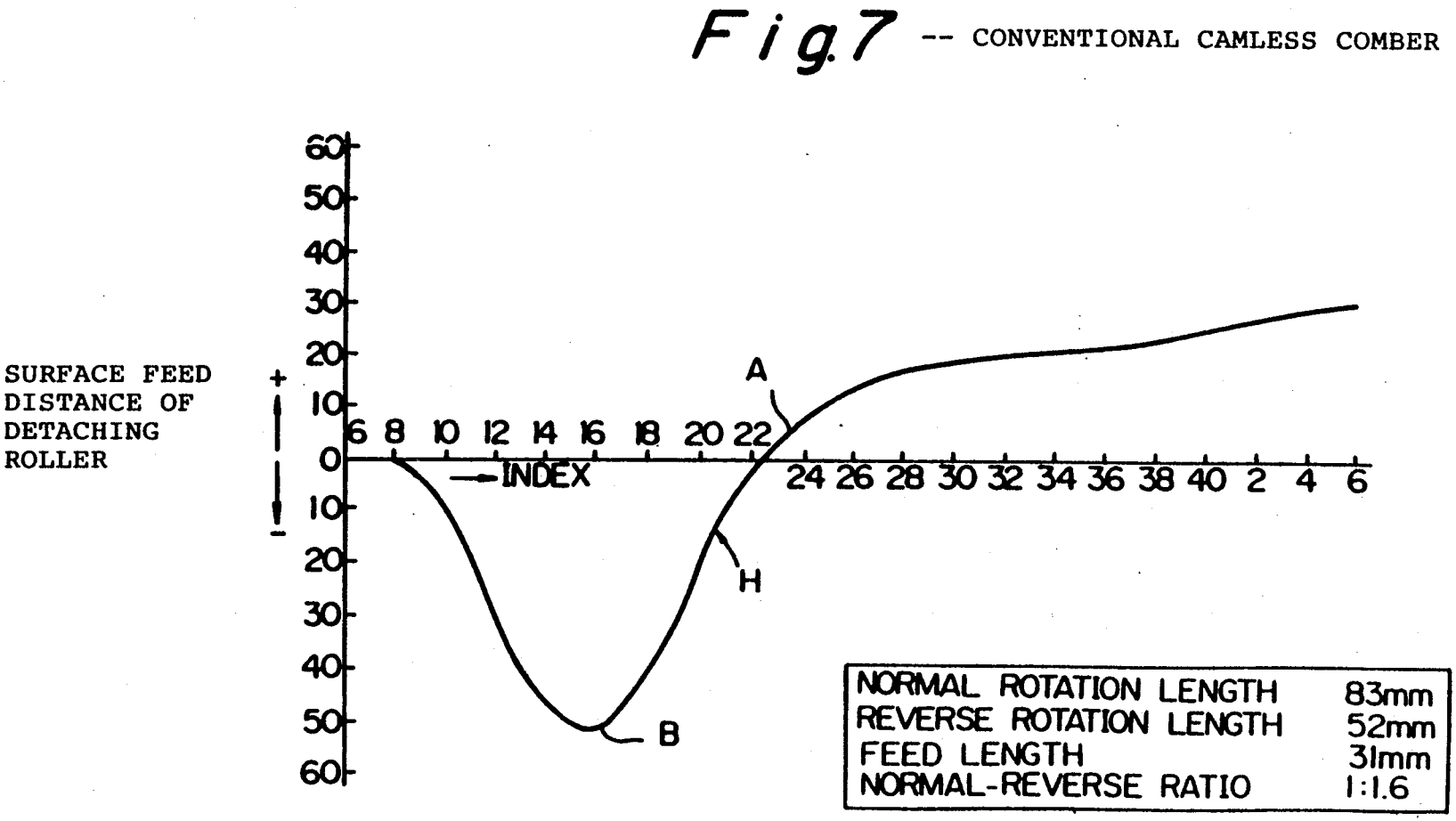
Fig.7 -- CONVENTIONAL CAMLESS COMBER
NORMAL ROTATION LENGTH 83mm
REVERSE ROTATION LENGTH 52mm
FEED LENGTH 31mm
NORMAL-REVERSE RATIO 1:1.6
A
B
H
INDEX
SURFACE FEED DISTANCE OF DETACHING ROLLER
+
-
60 50 40 30 20 10 0 10 20 30 40 50 60
6 8 10 12 14 16 18 20 22 24 26 28 30 32 34 36 38 40 2 4 6

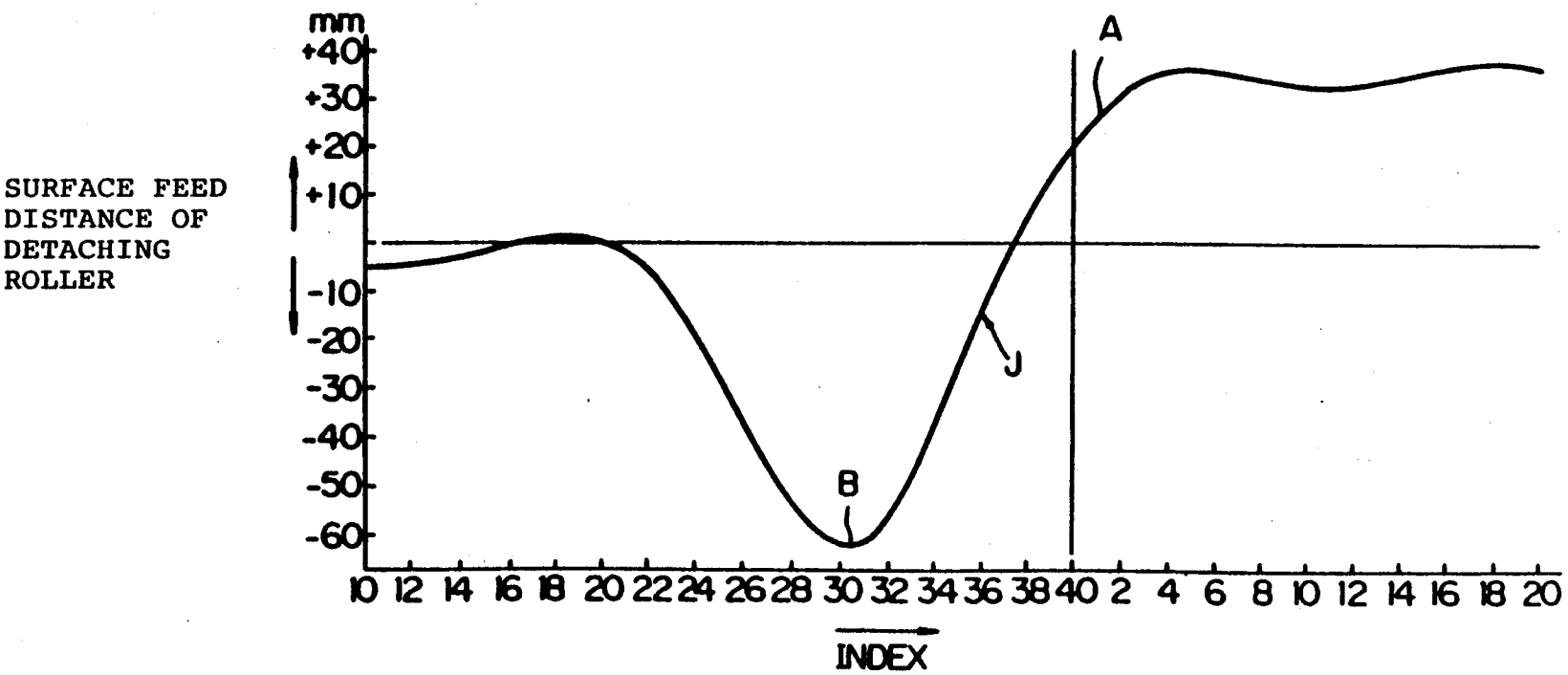
Fig.8 -- CONVENTIONAL CAMLESS COMBER

DETACHING ROLLER DRIVING MECHANISM FOR A COMBER EMPLOYING TWO DRIVING SYSTEMS

BACKGROUND OF THE INVENTION

1. Field of the Invention

The present invention relates to a detaching driving mechanism for a comber.

2. Description of the Related Art

The lap combing cycle of a comber includes the steps of combing the front end of a lap gripped at the rear end thereof by a nipper of a combing cylinder, advancing the nipper to move the combed fleece to detaching rollers, and reversing the detaching rollers in synchronism with the advancement of the nipper. This action reverses fleece pulled out from the lap in the preceding combing cycle so that the fleece combed in the present combing cycle overlaps the fleece combed in the preceding combing cycle, rotating the detaching rollers in the normal direction to pull off the combed fleece combed in the present combing cycle from the nipper, and combing the rear end of the fleece with a top comb. The rotation of the detaching rollers in the normal and reverse directions is transferred from the cylinder shaft to synchronize the same therewith. That, is the detaching rollers are stopped or slightly rotated during the first half of a full turn of the cylinder shaft, and are rotated in the normal direction immediately after the rotation in the reverse direction during the second half of a full turn of the cylinder shaft.

Such a reciprocating rotational motion of the detaching rollers is produced by combining a constant-speed rotative input and a variable-speed rotative input applied to a differential gear mechanism connected to the input shaft of the detaching roller unit. The variable-speed rotative input is applied by an input means employing a cam (Japanese Examined Patent Publication (Kokoku) No. 44-17573) or an input means employing a linkage (Japanese Examined Patent Publication (Kokoku) Nos. 43-10728 and 53-15178).

The input means employing a cam can obtain an ideal curve of motion for piecing and pulling a fleece by properly designing the cam surface of the cam. Nevertheless, the cam groove of the cam is quickly abraded because the inertia of driving members for transmitting the motion of a cam follower to the detaching roller unit is concentrated on the line of contact of the cam follower and the cam groove when reversing and accelerating the detaching rollers, which produces the advancing and reversing motions, and the mechanism is also expensive because the width and shape of the cam groove must have a precise accuracy.

When the components of the input means employing a cam are operated at high operating speed, to improve the productivity, a large impact of the cam and the cam follower, when changing the direction of rotation of the detaching rollers from the reverse direction to the normal direction generates noise and vibrations, accelerates the abrasion of the cam surface, shortens the lifetime of the machine, and deteriorates the quality of the combed slivers. Therefore, the input means employing a cam is unable to operate at a high operating speed, and the productive efficiency of a machine employing such an input means is unsatisfactory.

Although a comber employing an input means using a linkage, namely, a camless comber, is able to operate at a relatively high operating speed, only motion curves H and J as shown in FIGS. 7 and 8 are possible, and thus the fleece delivered by the feed roller of the nipper cannot be fully drafted because a portion A of the curve of motion shown in the drawing, in particular, can be formed only with a large radius of curvature, and severe noise and shocks are liable to be generated. Moreover, the parts are abraded quickly and are liable to be damaged because, in a portion B in which the rotation direction is changed from the reverse direction to the normal direction, the motion of the change is sudden. Consequently, the quality of slivers of long fibers is unsatisfactory.

SUMMARY OF THE INVENTION

An object of the present invention is to enable a camless comber capable of operating at a high operating speed to obtain an ideal curve of motion which is equal to that obtained by a cam comber, by providing the camless comber with a novel linkage.

As shown in FIG. 1, by way of example, a constant-speed rotating motion R of a drive is transmitted through a V belt 2 and a driving pulley 1 to two driving systems $D_1$ and $D_2$. The driving system $D_1$ converts the constant-speed rotating motion into a variable-speed rotating motion by a crank mechanism $C_1$ and a quadric crank mechanism L comprising links 26, 29 and 34, and transmits the variable-speed rotating motion through a shaft 35 to the input gear 39 of a differential gear mechanism G. The other driving system $D_2$ transmits the constant-speed rotating motion R through a crank mechanism $C_2$ to swing a swing lever 50 for a swing motion on a fixed pin 15 pivotally supporting the swing lever 50 at one end thereof. The swing motion of the swing lever 50 is transmitted through a lever and links to the planet gear unit of the differential gear mechanism, to reciprocate the planet gear unit. A connecting link 18 has one end pivotally joined to the swinging end of the swing lever 50 by a crank pin 17 and the other end pivotally jointed to the swinging end of a lever 20 pivotally supported on a joint pin 19. As shown in FIG. 3, a dead point on a line passing one terminal end b19 of the locus of circular motion of the lever 20 and the pin 15 supporting the swing lever 50 is located near the terminating end of the pin 17 on the swinging end of the swing lever 50, the pin 23 on the lever 20 is connected to the planet gear unit of the differential gear mechanism is connected by connecting link, and a dead point on a line passing a position b42 of the shaft 42 of the planet gear unit farthest from the pin 21 and the pin 21 on the lever 20 is located at the terminating end of the locus of circular reciprocating motion of a joint pin 23 on the swinging end of the lever 20.

A combined motion produced by combining the motion of the swing lever 50 in a dead zone of the swing motion and the motion of the lever 20 in a dead zone of the swing motion is transmitted to the planet gear unit of the differential gear mechanism to obtain a motion curve K having a bottom section equal to the sine curve of the original motion, and an upper section having a small radius of curvature representing a rapid reduction of the motion as shown in FIG. 5 is obtained for one cycle of operation of the swing lever 50.

The motion curve K is combined with a curve M produced by the driving system $D_1$ to obtain a motion curve N shown in FIG. 6.

The motion curve N of the detaching rollers has a section B of an unchanged sine curve for a reverse feed, and a section A having an ideal curve having a small radius of curvature for completing the forward feed of the fleece.

As apparent from FIG. 6, since the section B of the motion curve N of detaching rollers driven by the detaching roller driving mechanism of the present invention for a reverse feed deviates little from a sine curve, compared with motion curves H and J of the detaching rollers driven by the conventional detaching roller driving mechanism, a sudden change of motion of the detaching rollers can be avoided, so that noise and an exposure of component parts to impact can be avoided, and thus the abrasion of the component parts can be suppressed and damage to the same can be avoided. Since the radius of curvature of the section A is far smaller than that of the corresponding section of the curve of motion of the detaching rollers driven by the conventional detaching roller driving mechanism, the length $L_3$ of the fleece delivered during the rotation of the cylinder shaft from an angular position $P_0$ corresponding to the start of a forward feed to an angular position $P_1$ corresponding to the foremost position of the nipper, namely, the termination of the delivery of the fleece, is longer than the length ($L_1$, $L_2$) of the fleece delivered during the same period by the detaching rollers driven by the conventional detaching roller driving mechanism, so that the fleece fed by the feed roller of the nipper can be fully combed.

BRIEF DESCRIPTION OF THE DRAWINGS

FIGS. 7 and 8 are graphs showing curves of the feed motion of the detaching rollers of a conventional camless comber.

DESCRIPTION OF THE PREFERRED EMBODIMENTS

Figure 1:
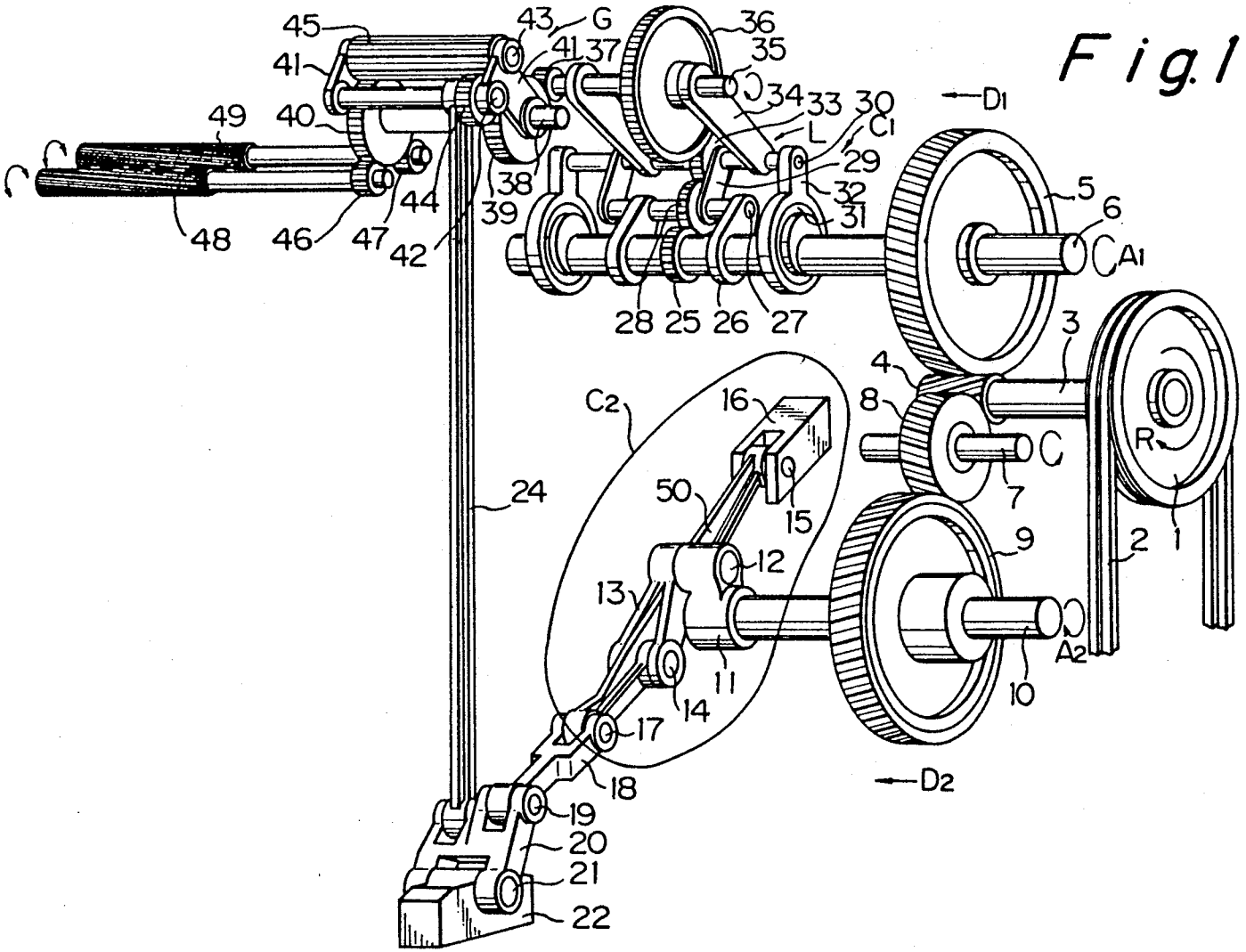
FIG. 1 is a perspective view of an essential portion of a detaching roller driving mechanism embodying the present invention.
Figure 2:
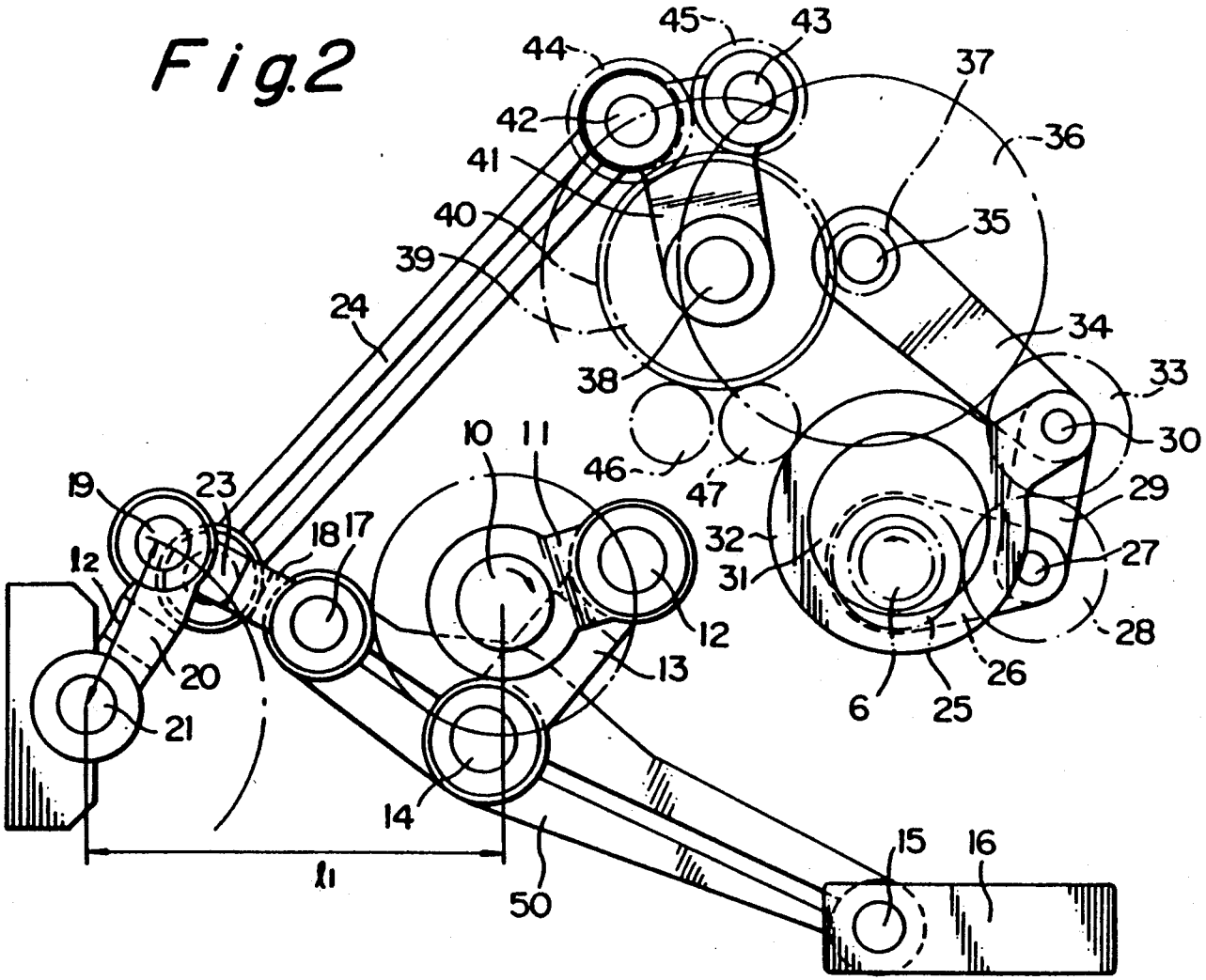
FIG. 2 is a side elevation of the essential portion shown in FIG. 1.
Figure 4:
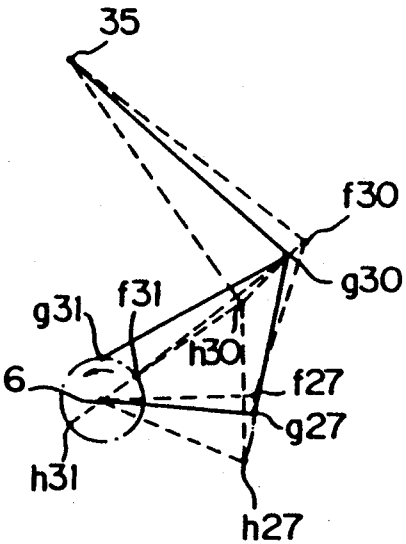
FIG. 4 is a diagram of assistance in explaining the motion of another driving system ($D_1$) included in the detaching roller driving mechanism embodying the present invention.

As shown in FIGS. 1 and 2, a driving pulley 1 is connected to a drive, not shown, by a V belt 2. The pulley 1 is fixed to a driving shaft 3. A pinion 4 mounted on the driving shaft 3 engages a gear 5 mounted on a cylinder shaft 6 and a gear 8 mounted on an intermediate shaft 7. The intermediate gear 8 engages a gear 9 mounted on a crankshaft 10. The gears 5 and 9 have the same tooth number. The constant-speed rotating motion R of the driving pulley 1 is transmitted through the cylinder shaft 6 to a driving system $D_1$ and through the crankshaft 10 to a driving system $D_2$.

Driving system $D_1$

A gear 25 and eccentric cams 31 are fixed to the cylinder shaft 6, and links 26 are supported rotatably on the cylinder shaft 6. A shaft 27 is supported on the free ends of the links 26. A gear 28 and links 29 are supported rotatably on the shaft 27. A pin 30 is fixed to the free ends of links 32 combined with the eccentric cams 31. The links 29, links 34 and a gear 33 are supported rotatably on the pin 30. A shaft 35 is supported for rotation in bearings, not shown, at a fixed position. Gears 26 and 27 are mounted fixedly on the shaft 35, and links 34 are mounted on the shaft 35 for swing motion relative to the shaft 35. The gears 25, 28, 33 and 36 are in continuous mesh, in that order. A gear 37 is in mesh with a gear 39.

Driving system $D_2$

A crankshaft 10 is fixedly provided with a crank 11, and a crank pin 12 revolves around the crankshaft 10 when the crankshaft 10 is rotated.

A block 16 is fixed to a frame, not shown, and a pin 15 is supported on the block 16. A swing lever 50 is supported for a swing motion on the pin 15. A connecting rod 13 has one end joined to the crank 11 by the crank pin 12 and the other end joined to the swing lever 50 by a joint pin 14.

Figure 3:
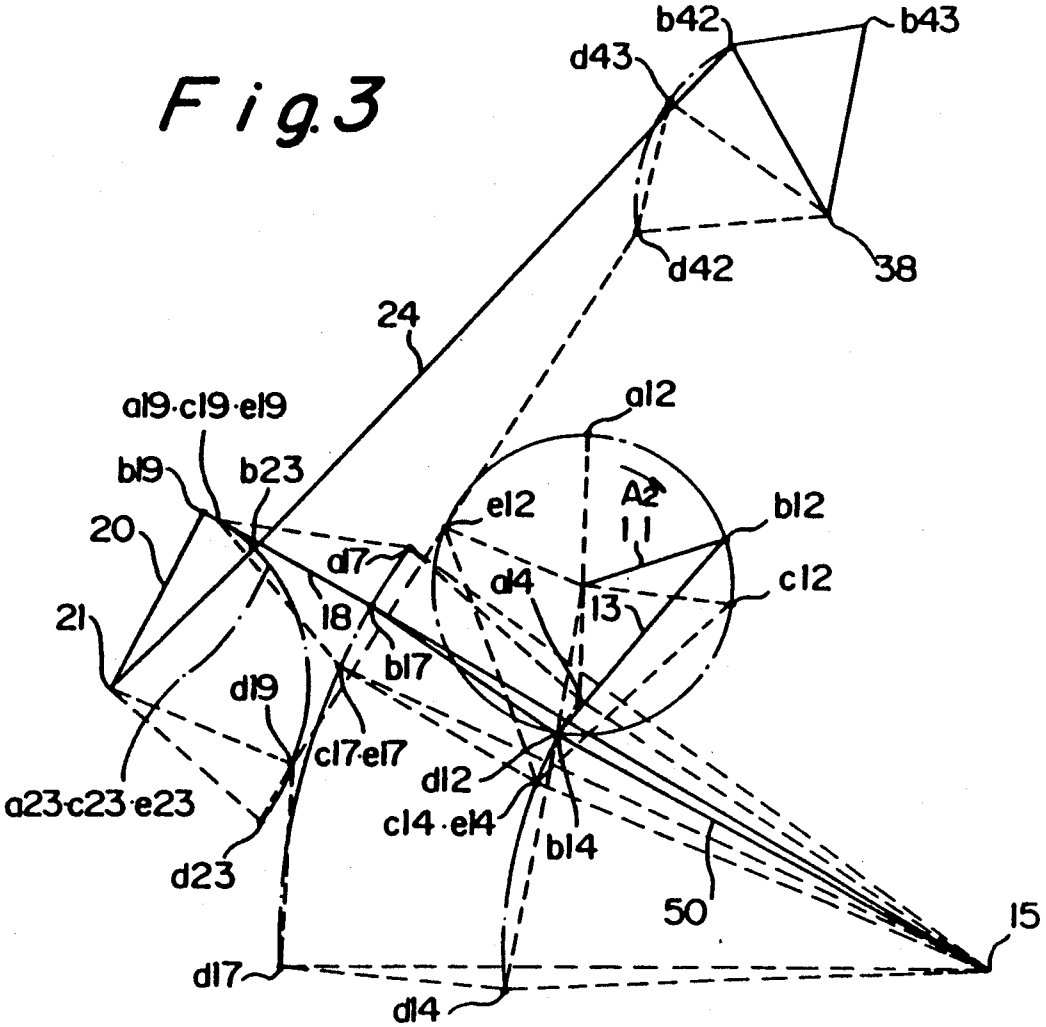
FIG. 3 is a diagram of assistance in explaining the motion of a driving system ($D_2$) included in the detaching roller driving mechanism embodying the present invention.

When the crank 11 is turned, the swing lever 50 swings on the pin 15 so that the joint pin 14 and a joint pin 17 reciprocate between positions a14 and d14 and between positions a17 and d17, respectively, as shown in FIG. 3.

A block 22 is fixed to a frame, not shown, and supports a shaft 21. A lever 20 is supported pivotally on the pin 21 for a swing motion, and joint pins 19 and 23 are attached to the free ends of the lever 20. A connecting link 18 has one end pivotally joined to the joint pin 17 and the other end pivotally joined to the joint pin 19. A connecting rod 24 has one end pivotally joined to the joint pin 23 and the other end pivotally joined to the shaft 42 of a differential gear mechanism.

The joint pins 19 and 23, and the shaft 42 reciprocate between positions b19 and d19, between positions b23 and d23, and between positions b42 and d42, respectively.

The values of $l_1$ and $l_2$ (FIG. 2) are determined selectively to determine the radius of curvature of a section A of a curve of motion. For example, when the values of $l_1$ and $l_2$ are increased and the sizes of the related members are changed accordingly, the radius of curvature of the section A increases, and thus the curvature of the curve is reduced.

Differential Gear Mechanism G

A shaft 38 is supported for rotation in bearings, not shown, at a fixed position. Levers 41 are fixed to the shaft 38, and shafts 42 and 43 are supported fixedly on the levers 41. Gears 39 and 40 are supported rotatably on the shaft 38. A gear 44 is supported rotatably on the shaft 42, and the end of the connecting rod 24 is joined pivotally to the shaft 42. A gear 45 is supported rotatably on the shaft 43. Gears 39 and 44, gears 44 and 45 and gears 45 and 40 are meshed, respectively. The gears 39 and 45 are separated from each other. The gear 40 is in engagement with gears 46 and 47 fixedly mounted respectively on detaching rollers 48 and 49.

Action of the Driving System $D_1$

When the eccentric cams 31 rotate together with the cylinder shaft 6 in the direction of an arrow $A_1$ (FIG. 1), the pin 30 reciprocates between positions f30 and h30 as the centers of the eccentric cams 31 revolves through angular positions f31, g31, h31 and f31, whereby the shaft 27 is reciprocated between positions f27 and h27. The rotation of the cylinder shaft 6 is transmitted through the gears 25, 28, 33, 36, 37, 39, 44, 45 and 40 to the gears 46 and 47 to rotate the detaching rollers 48 and 49.

If the shaft 42 does not move, the surface feed distance of the detaching rollers 48 and 49 varies along a curve M (FIG. 5) with the rotation of the cylinder shaft 6.

Driving System $D_2$

The crankshaft 10 rotates at a rotating speed equal to that of the cylinder shaft 6 in a direction indicated by an arrow $A_2$ (FIG. 1) opposite to that of rotation of the cylinder shaft 6. As shown in FIG. 3, when the crankshaft 10 is rotated in the direction of the arrow $A_2$ to turn the crank pin 12 through angular positions a12, b12, c12, d12, e12 and a12, the joint pin 14 is reciprocated between positions a14 and d14 via positions b14, c14, d14 and e14, the joint pin 17 is reciprocated between positions a17 and d17 via positions b17, c17, d17 and e17, the joint pin 19 moves through positions a19, b19, c19, d19, e19, b19, a19, b19, c19 and d19, in that order, and the joint pin 23 moves according to the movement of the joint pin 19. At the same time, the shaft is reciprocated between positions b42 and d42.

When the difference between the respective lengths of the crank 11 and the connecting rod 13 is relatively small, the joint pin 14 moves at a relatively low speed in the vicinity of the position a14, and moves at a relatively high speed from a position after the position c14 to the position e14. When the crank 11 is at the angular position b12, the positions b19 and b17 and the pin 15 are aligned to locate the lever 20 at the dead point thereof, and the pin 21 and the position b23 and b42 are aligned to locate the shaft 42 at the dead point thereof.

Accordingly, while the crank 11 is turning from the position e12 via the position a12 to the position c12, the joint pin 23 moves from the position e23 via the position b23 to the c23, and the shaft 42 moves slightly in the vicinity of the position b42 and remains substantially stationary.

While the crank 11 moves from the position c12 via the position d12 to the position e12, the joint pin moves from the position c23 via the position d23 to the position e23, and the shaft 42 reciprocates between the positions b42 and d42.

The gear 44 is supported rotatably on the shaft 42, and the differential gear mechanism G comprises the gears 39, 44, 45 and 40. Therefore, the gear 40 is moved at a fixed speed ratio by the shaft 42 when the gear 39 is fixed, and the gears 46 and 47 is rotated by the gear 40 to rotate the detaching rollers 48 and 49. The surface feed distance of the detaching rollers 48 and 49 varies along a curve K (FIG. 5) during one full turn of the crank 11.

Composite Action of the Driving Systems

Figure 5:
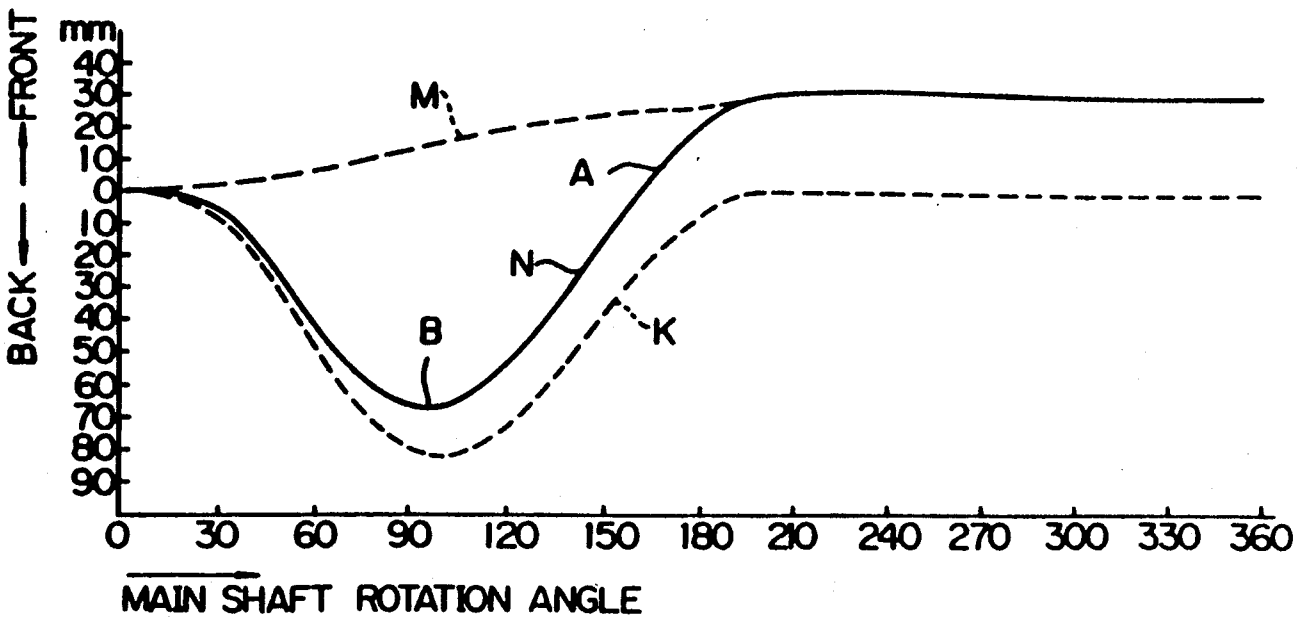
FIG. 5 is a graph showing a curve representing the feed motion of detaching rollers driven by the detaching roller driving mechanism embodying the present invention.
Figure 6:
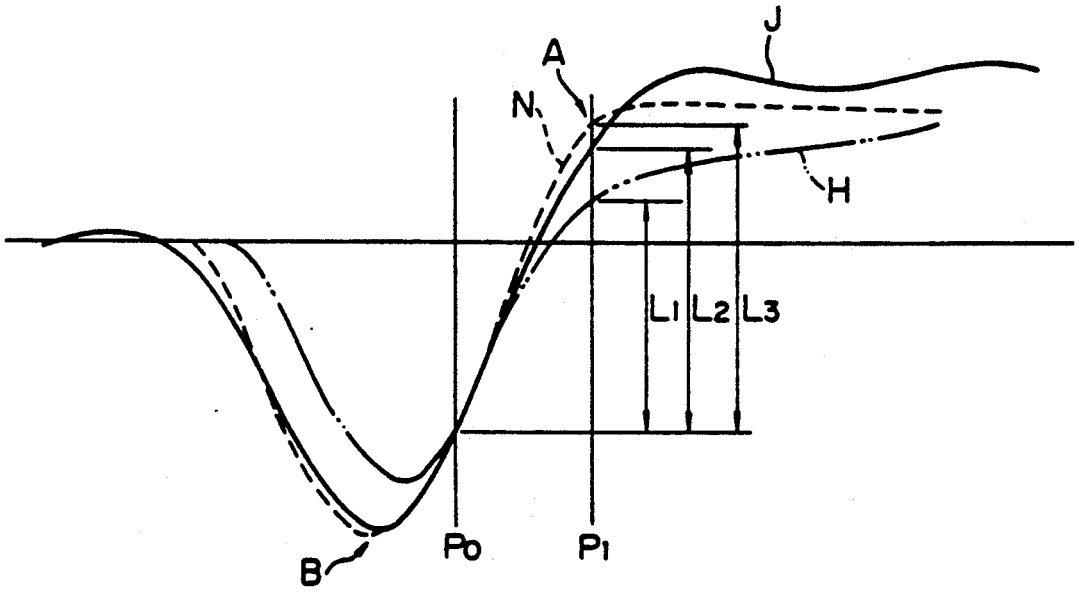
FIG. 6 is a graph comparatively showing a curve representing the feed motion of detaching rollers driven by the detaching roller driving mechanism embodying the present invention, and curves representing the feed motions of detaching rollers driven by conventional detaching roller driving mechanism.

The driving systems $D_1$ and $D_2$ were interlocked so that the substantially horizontal section of the curve M representing the variation of the surface feed distance of the detaching rollers 48 and 49 as driven by the driving system $D_1$ and the substantially horizontal section of the curve K representing the variation of the surface feed distance of the detaching rollers 48 and 49 as driven by the driving system $D_2$ coincide with each other as shown in FIG. 5 to obtain a curve N by combining the curves M and K.

When the radius of curvature of a section B of the curve N is maintained equal to that of the corresponding section of the curve K (sine curve) to reduce the angle between slopes before and after reversing and to increase the stopping time of the shaft 42, the radius of curvature of a section of the curve K corresponding to a section A of the curve N can be reduced.

When the length of the lever 41 is reduced without changing the position of the shaft 38, the radius of curvature during the reverse operation is substantially the same, the angle between the slopes respectively in the normal operation and the reverse operation can be reduced, and thus the surface feed distance of the detaching rollers during rotation in the normal direction is increased.

The same effect and function can be obtained when the center distance between the pin 21 and the shaft 42 is fixed and the length of the lever 20 is increased.

We claim:

1. A detaching roller driving mechanism for driving the detaching rollers of a comber, comprising: a differential gear mechanism having an input shaft and a planet pinion; a first driving system for converting a constant-speed rotative motion of a drive transmitted thereto into a variable-speed rotative motion through a crank mechanism and a quadric crank mechanism, said first driving system transmitting the variable-speed rotative motion to the input shaft of the differential gear mechanism; and a second driving system for converting a constant-speed rotative motion transmitted thereto into a swing motion by a crank mechanism, for converting the swing motion into a reciprocating motion by connecting rods and linkage, and for transmitting the reciprocating motion to the planet pinion of the differential gear mechanism; and including a swing lever and a crankshaft having a crank mounted thereon, said swing lever having a swinging end and a pivotal end mounted on a first pin, said swinging end of the swing lever being swung on the first pin through a connecting rod by the crank, said swinging end of the swing lever being pivotally connected to one end of a connecting link by the crank pin, a swinging end of a lever supported at a pivotal end thereof for swinging motion on a second pin being connected pivotally to an opposite end of the connecting link by a joint pin, a point on a line passing through a terminating end of the locus of the circular motion of the lever and the first pin being located near an end of the locus of circular reciprocating motion of the crank pin, a connecting rod having one end pivotally joined to the swinging end of the lever by a joint pin and an opposite end connected to the planet pinion of the differential gear mechanism, and a point on a line passing through the second pin and a position of the input shaft of a planet gear of the differential gear mechanism farthest from the second pin coinciding with an end of the locus of the circular reciprocating motion of the joint pin of the lever.

* * * * *